US009206627B2

(12) United States Patent
Lin

(10) Patent No.: US 9,206,627 B2
(45) Date of Patent: Dec. 8, 2015

(54) ENGAGEMENT STRUCTURE FOR A CABLE HEAD

(71) Applicant: LINTEX CO., LTD., Zhanghua County (TW)

(72) Inventor: Chia-Sheng Lin, Zhanghua County (TW)

(73) Assignee: LINTEX CO., LTD., Zhanghua County (TW)

( * ) Notice: Subject to any disclaimer, the term of this patent is extended or adjusted under 35 U.S.C. 154(b) by 0 days.

(21) Appl. No.: 14/455,911

(22) Filed: Aug. 10, 2014

(65) Prior Publication Data

US 2014/0345335 A1 Nov. 27, 2014

Related U.S. Application Data

(63) Continuation-in-part of application No. 13/739,971, filed on Jan. 11, 2013, now abandoned.

(30) Foreign Application Priority Data

Oct. 26, 2012 (TW) ..... 101220773

(51) Int. Cl.
*E05B 67/06* (2006.01)
*E05B 73/00* (2006.01)

(52) U.S. Cl.
CPC ..... *E05B 73/0005* (2013.01); *E05B 73/0082* (2013.01); *Y10T 70/402* (2015.04)

(58) Field of Classification Search
CPC ..... E05B 67/00; E05B 67/003; E05B 67/006; E05B 67/063; E05B 67/22; E05B 69/00; E05B 71/00; E05B 73/00; E05B 73/0005; E05B 73/0011; E05B 73/0082; E05B 2073/0088
USPC ..... 70/30, 49, 51, 53
See application file for complete search history.

(56) References Cited

U.S. PATENT DOCUMENTS

| | | | | |
|---|---|---|---|---|
| 4,896,517 | A * | 1/1990 | Ling | 70/18 |
| 6,026,664 | A * | 2/2000 | Lin | 70/49 |
| 6,546,768 | B1 * | 4/2003 | Burghoff et al. | 70/252 |
| 7,017,378 | B2 * | 3/2006 | Hsieh | 70/49 |
| 7,047,772 | B2 * | 5/2006 | Yu | 70/21 |
| 7,251,965 | B2 * | 8/2007 | Yu | 70/21 |
| 7,428,833 | B2 * | 9/2008 | Tollefson | 70/49 |
| 7,997,106 | B2 * | 8/2011 | Mahaffey et al. | 70/58 |
| 8,001,815 | B2 * | 8/2011 | Pitschke | 70/389 |

* cited by examiner

*Primary Examiner* — Christopher Boswell

(57) ABSTRACT

An engagement structure for a cable head includes a main body and a release mechanism. The main body has movable positioners disposed thereon. When the cable head is inserted in the main body, the positioners are temporarily pushed away and moved back by an elastic mechanism to block the cable head from removing from the main body. For removing the cable head, a release mechanism is configured for pushing the positioners away. Thus, user can remove the cable head by operating the release mechanism. Therefore, operation of the engagement structure is simplified for user.

11 Claims, 7 Drawing Sheets

ENGAGEMENT STRUCTURE FOR A CABLE HEAD

FIELD OF THE INVENTION

The present invention is a CIP of application Ser. No. 13/739,971, filed Jan. 11, 2013, the entire contents of which are hereby incorporated by reference.

BACKGROUND OF THE INVENTION

Description of the Prior Art

Accompanied with technology improvement, electronic products, such as mobile phones and tablet personal computers, are now popularized to consumer. To fulfill portability purpose, the electronic products are provided with minimized sizes. However, the smaller sizes the electronic products have, the easier the thievery occurs, especially in hypermarkets and exhibitions. To preventing thievery, the electronic products are always firmly engaged with and protected by locks. Thus, unauthorized possession of the electronic products can be effectively forbidden.

In cases of computer, laptop computers are usually provided with slots with which are adapted for locks to engage. Conventional locks, such as the lock described in TW Utility Model No. M407943, are operated with keys to drive a guiding seat to lead a movement of a pin. The pin is moved along a mortise which is inserted in the slot provided on the computer and is moved into the slot. Thus, the mortise and the pin are configured to engage with the computer together. However, the lock is too complicated to use. The mortise has to be inserted into the slot firstly, or the engagement achieved by insertion of the pin would be failure. Therefore, the conventional locks are inconvenient for user.

US 2009/0025439 discloses a device for starting and operating an engine in a motor vehicle. In US 2009/0025439, two levers are pivoted to the main body (mounting plate) respectively and entirely not beyond the main body. The two levers are not protrusive out of the main body for being actuated by a pushing member. The two levers are not pressed by the ID transmitter and not moved away from each other in parallel. In fact, the ID transmitter is provided to actuate the two levers but not lock with two levers, and the engaging means and the lugs are always slidably relative to each other, thus providing no anti-theft function. Furthermore, to function, the release mechanism moves straightly but not swingably to press the two levers, so that the structural size should be large for movement of the straightly-moving release mechanism.

The present invention is, therefore, arisen to obviate or at least mitigate the above mentioned disadvantages.

SUMMARY OF THE INVENTION

The main object of the present invention is to provide a structure for locking quickly and easily.

To achieve the above and other objects, an engagement structure for a cable head of the present invention includes a main body and a release mechanism, wherein one end of the cable head is formed with an insertion end.

The main body has two fixation members oppositely fixedly disposed thereon, two grooves oppositely arranged and laterally slit at two opposite sides thereof, two positioners oppositely slidably arranged in the two grooves and substantially in parallel, and an elastic mechanism disposed between the two fixation members and the two positioners. Each positioner is not positionally pivoted to the main body, and the elastic mechanism urges the two positioners to tend to move substantially in parallel toward each other so as to releasably block the insertion end which is inserted in the main body. The release mechanism selectively drives the two positioners to move substantially in parallel away from each other to release block of the two positioners and the insertion end so that the insertion end is withdrawable outside form the main body. The insertion end is removably insertable in the main body, and the insertion end is releasably blockable with the two positioners when the insertion end is inserted into the main body. The release mechanism is arranged separately beside the main body and the parts of the positioners, and a protruding portion of the release mechanism is selectively moveable toward the two positioners to press the positioners so that the two positioners move substantially in parallel away from each other and the block of the two positioners and the insertion end is released.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
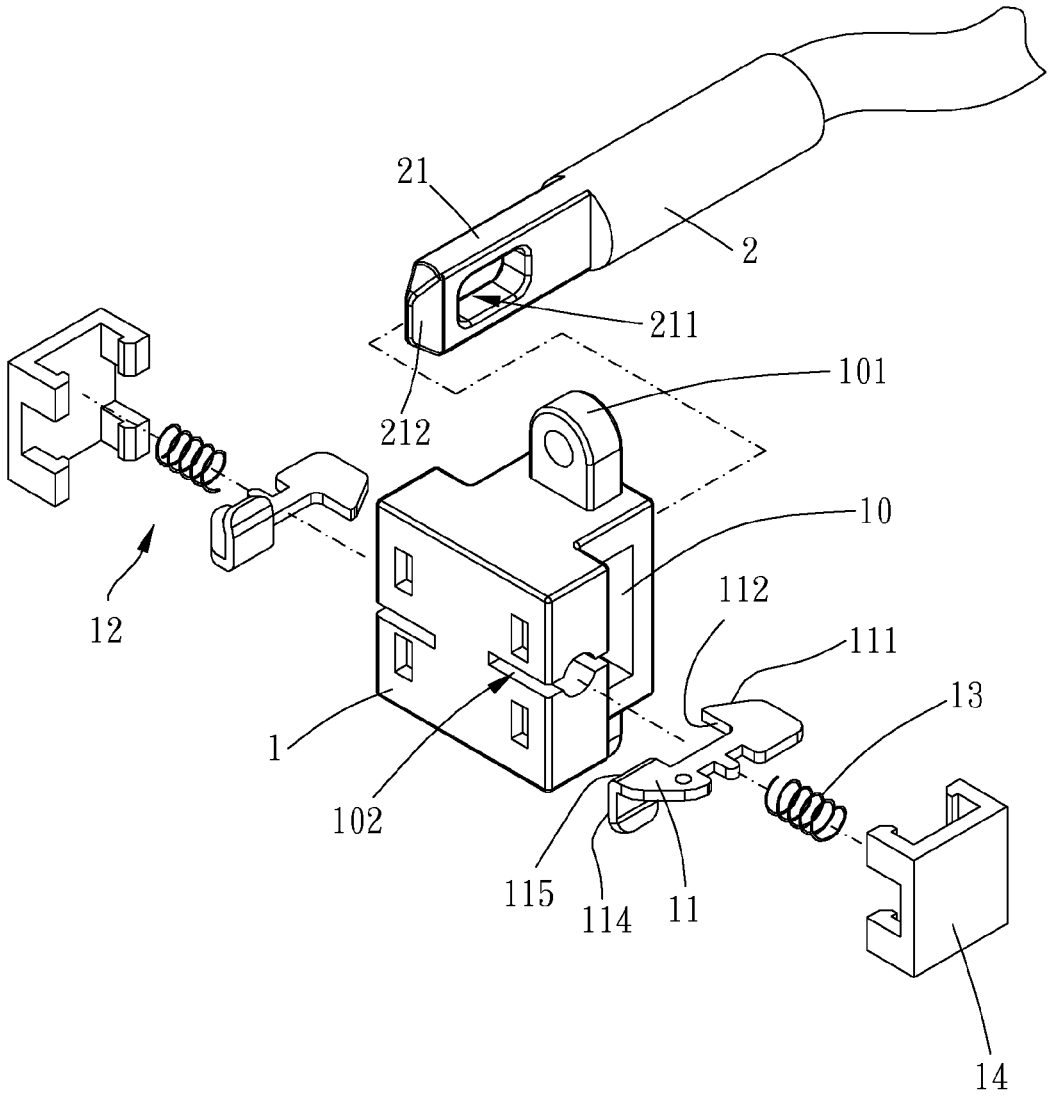
FIG. 1 is a breakdown drawing showing a first embodiment of the present invention.

Please refer to FIG. 1 to FIG. 4 for a first embodiment of the present invention. The engagement structure for cable head of the present embodiment includes a main body 1, a cable head 2, and a release mechanism 3.

The main body 1 is formed with a through hole 10 and a connection portion 101. In the present embodiment, the connection portion 101 has a hole which is provided for fixing the main body 1 on an electronic product or other structures by threads. Of course, the connection portion may be provided in other formation to mate with the structure with which the engagement structure is going to fit. The main body 1 has two fixation members 14 oppositely fixedly disposed thereon, two grooves 102 oppositely arranged and laterally slit at two opposite sides thereof, two positioners 11 oppositely slidably arranged in the two grooves 102 and substantially in parallel, and an elastic mechanism 12 which are disposed between the two fixation members 14 and the two positioners 11 respectively. Each positioner 11 is not positionally pivoted to the main body 1. Specifically, the elastic mechanism 12 includes two springs 13 which are disposed between the two fixation members 14 and the two positioners 11 respectively.

Part of each positioner 11 is protrusive outside the main body 1 and opposite to the through hole 10 of the main body 1 through which an insertion end 21 of the cable head 2 is inserted.

Each fixation member 14 is formed as a cover and the two fixation members 14 are removably engaged with two corresponding sides of the main body 1. The two positioners 11 are restricted by the two fixation members 14 so that the two positioners 11 are unable to move apart from the main body 1, and the two springs 13 are covered inside the main body 1 by the two fixation members 14. The guiding surfaces 114 face toward each other. The guiding surfaces 114 are formed with tilted surfaces 115 at the top ends thereof. The springs 13 press the positioners 11 so that the positioners 11 are biased to tend to move substantially in parallel toward each other In other word, the positioners 11 have tendency to move close to each other.

Figure 2:
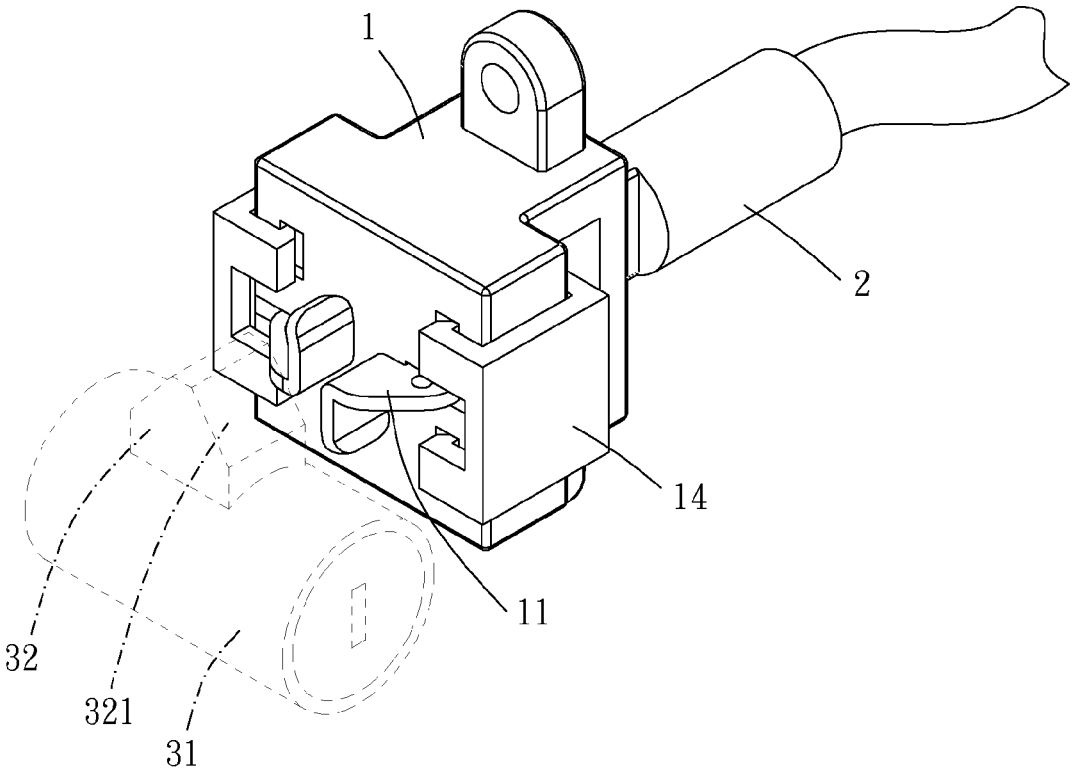
FIG. 2 is a stereogram showing the first embodiment of the present invention.
Figure 3:
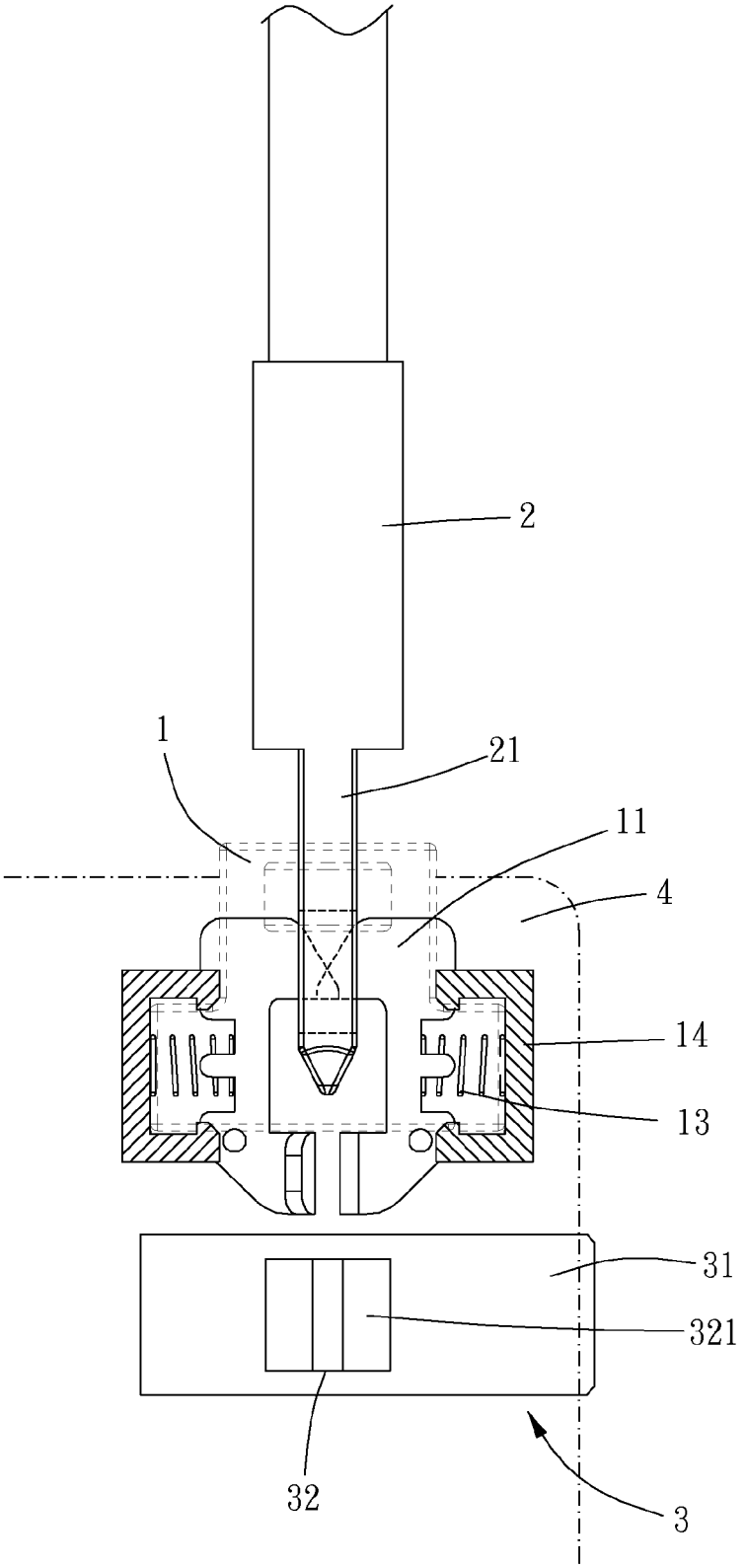
FIG. 3 and FIG. 4 are schematic drawings showing an operation condition of the first embodiment of the present invention.
Figure 4:
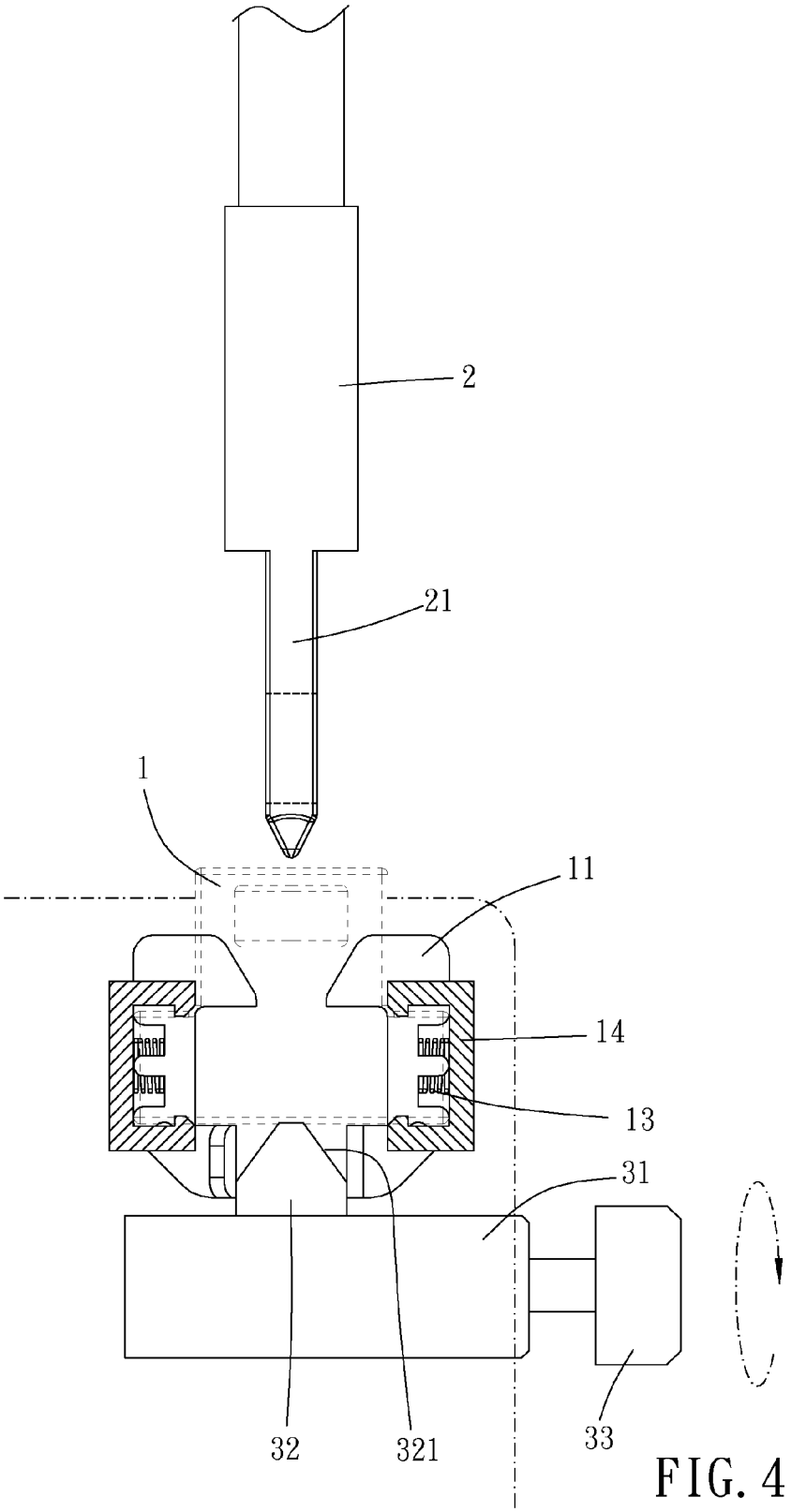
Figure 5:
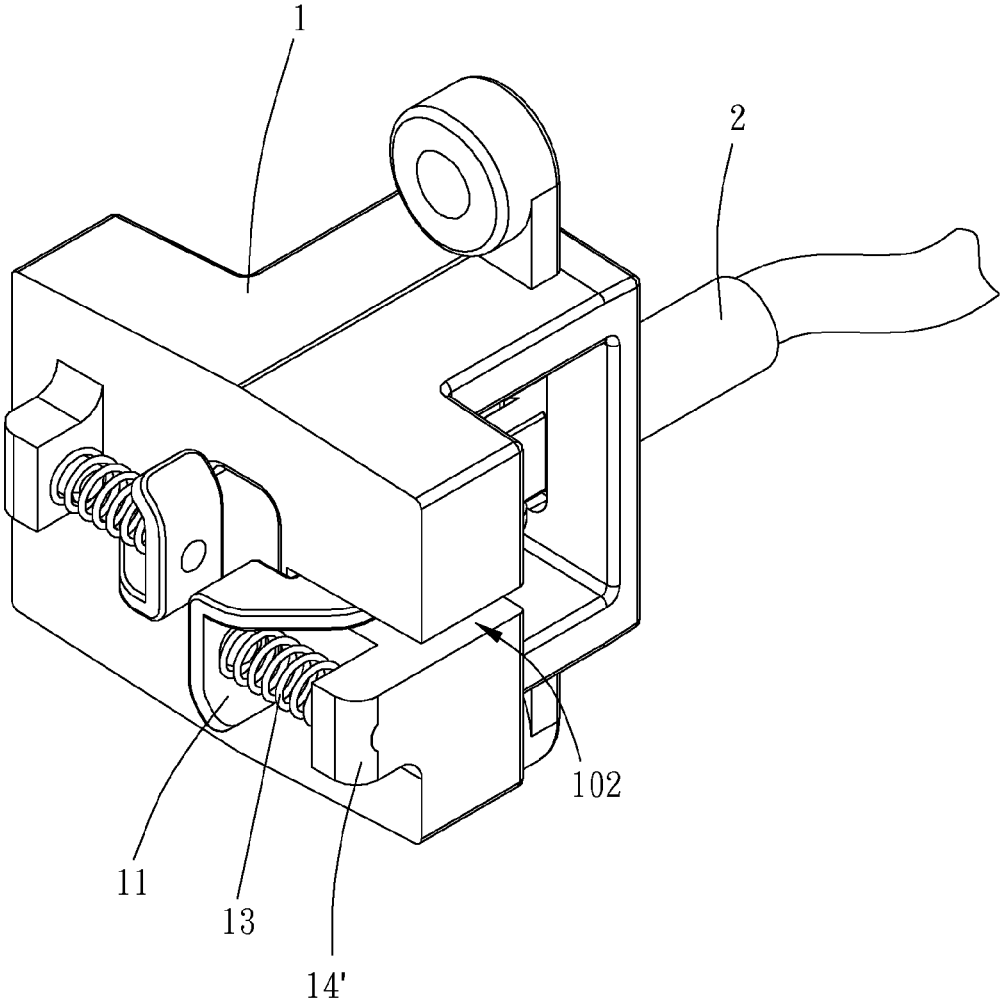
FIG. 5 is a stereogram showing a second embodiment of the present invention.
Figure 6:
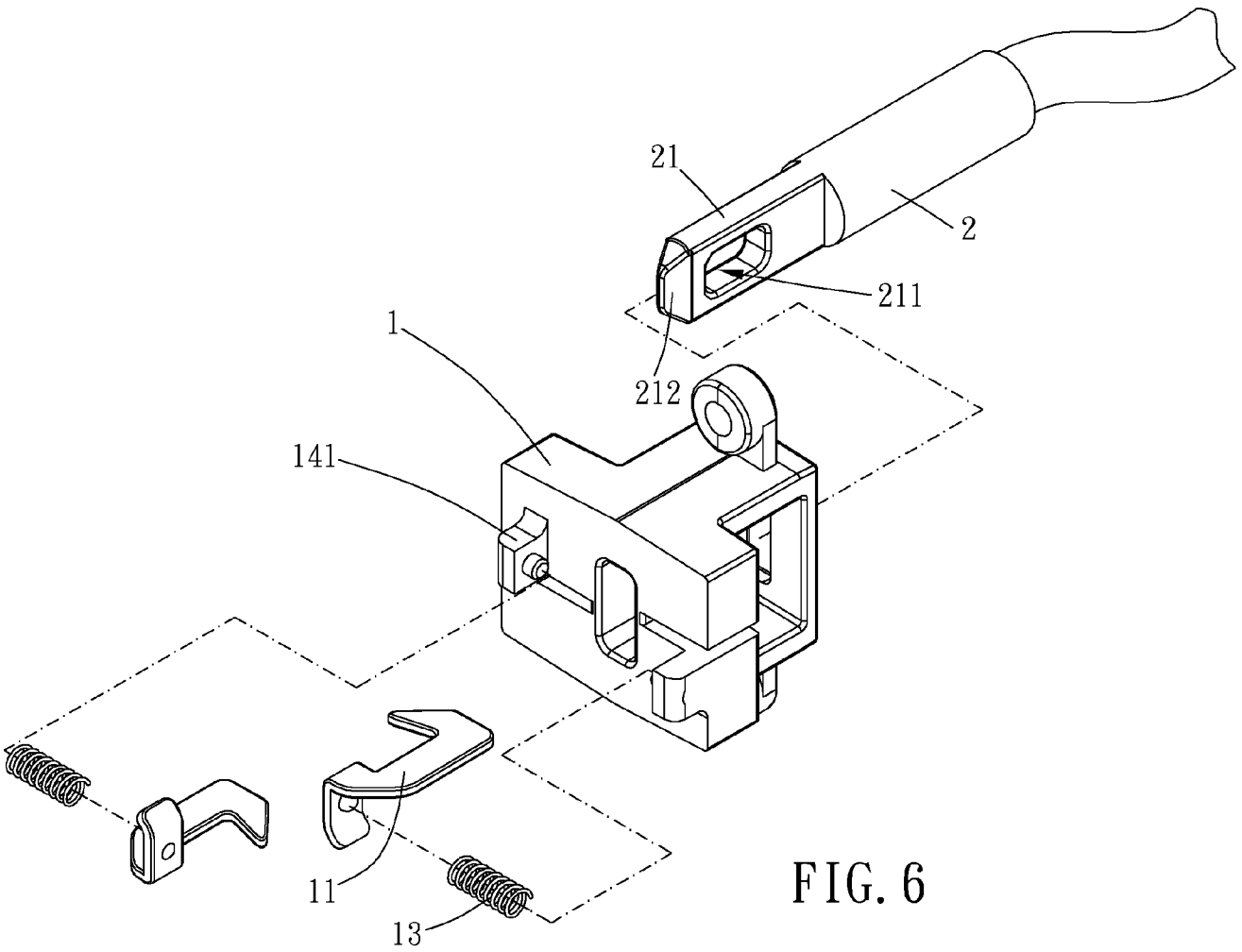
FIG. 6 is a breakdown drawing showing the second embodiment of the present invention.
Figures 7, 8, 9:
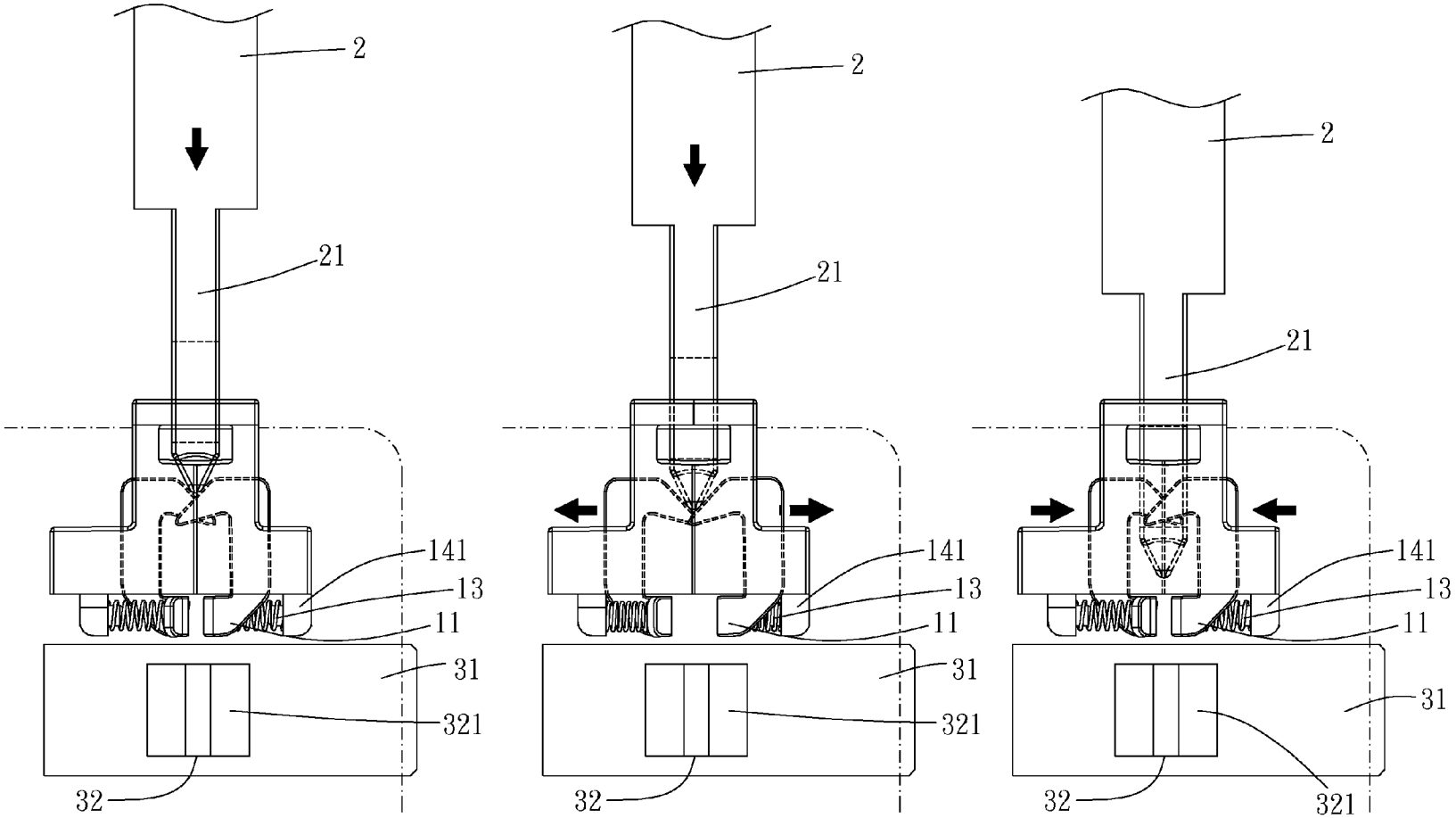
FIGS. 7-9 are schematic drawings showing an operation condition of the second embodiment of the present invention.

Each of the positioners 11 has a first end and a second end. The first end has a guiding portion 111 and a hook portion 112. In the present embodiment, the guiding portion 111 is an edge structure which extends slantly along an extension direction of the edge structure. In some cases, the guiding portion 111 may be a tilted surface structure. The second end has a guiding surface 114. When the positioners 11 are located at a blocking position, as shown in FIG. 2, and FIG. 3, the hook portions 112 are located close to each other. Preferably, the positioners 11 are located at different altitude, and the hook portions 112 slightly overlap with each other. When the positioners 11 are located at a release position, as shown in FIG. 4, the hook portions 112 are located away from each other.

One end of the cable head 2 is formed with the insertion end 21, the other end is adapted for wires, lines, or other structures to connect to. The insertion end 21 inserts removably in the main body 1 via the through hole 10. The insertion end 21 is releasably blocked with the two positioners 11 when the insertion end 21 is inserted into the main body 1. When the insertion end 21 is inserted in the main body 1, the positioners 11 are located at two corresponding sides of the insertion end 21. In other words, the insertion end 21 is inserted and located between the positioners 11. The insertion end 21 has a limiting portion 211 which is a through hole (however, may be two blind holes) in the present embodiment. When the insertion end 21 is inserted into the main body 1, the hook portions 112 of the positioners 11 block the limiting portion 211 of the insertion end 21, so that the main body 1 and the cable head 2 are unable to be separated from each other. The term "block" is taken only in that the hook portion 112 is able to limiting movement of the insertion end 21 and keeping the main body 1 and the cable head 2 together. That is to say, the hook portion 112 is not necessary to touch the insertion end 21 continuously. In other possible embodiments of the present invention, the limiting portion may be formed as grooves 102, protrusions, or other structures corresponding to the hook portion. When the positioners 11 are located at the release position, the hook portions 112 are located away from each other, and the insertion end 21 is able to move in and out from the main body 1 arbitrarily. The insertion end 21 has a first pushing portion which includes two surfaces 212 tilted with respect to each other. As such, the distal end of the insertion end 21 is shrunk as a ridge or a pyramid. When the insertion end 21 is inserted into the main body 1, the surfaces 212 are parallel to the guiding portion 111, and the surfaces 212 press against the guiding portions 111 of the positioners 11. As such, the positioners 11 are pushed and moved away from each other, allowing insertion end 21 to move into the main body 1. After the insertion end 21 is inserted in the main body 1, the positioners 11 are returned to the first positions by pressing of the elastic mechanism 12. The hook portions 112 block the insertion end 21. Thus, the main body 1 and the cable head 2 are unable to be separated from each other, as shown in FIG. 3.

The release mechanism 3 selectively drives the positioners 11 to move substantially in parallel away from each other to release block of the two positioners 11 and the insertion end 21 so that the insertion end 21 is withdrawable outside form the main body 1. The release mechanism 3 is arranged separately beside the main body 1 and the parts of the positioners 11, a radially-outward protruding portion of the release mechanism 3 remote from the parts of the positioners 11 is selectively swingable toward the parts of the two positioners 11 to press the parts of the positioners 11 so that the two positioners 11 move substantially in parallel away from each other and the block of the two positioners 11 and the insertion end 21 is released.

In the present embodiment, the release mechanism 3 includes a lock 31, a second pushing portion 32 provided on the radially-outward protruding portion, and a key 33. The second pushing portion 32 is disposed on the lock 31. The second pushing portion 32 can rotate with respect to the lock 31. The key 33 can be inserted in the lock 31, driving the second pushing portion 32 to rotate. The second pushing portion 32 selectively presses the parts of the positioners 11 so that the two positioners 11 move substantially in parallel away from each other and the block of the two positioners 11 and the insertion end 21 is released. The second pushing portion 32 is formed with two pushing surfaces 321 which slant with respect to each other. Thus, the end portion of the second pushing portion 32 is shrunk as a ridge or a pyramid. The pushing portion 32 presses on the positioners 11 by the pushing surfaces 321. As the second pushing portion 32 rotates, the guiding surfaces 114 of the positioners 11 are pressed by the second pushing portion 32, as shown in FIG. 4. The second pushing portion 32 is then located between the positioners 11. The first ends of the positioners 11 are moved in parallel away from each other. Thus, blocking of the insertion end 21 achieved by the hook portions 112 is relieved. Therefore, by operating the key 33, the second pushing portion 32 can be controlled to push the positioners 11, moving the positioners 11 to the release position. Blocking of the insertion end 21 achieved by the hook portions 112 is then relieved, and the cable head 2 can be removed from the main body 1. Beside, the lock of the release mechanism can be replaced by other suitable locks which need no key to be operated, such as combination locks.

Accordingly, in practical using, the main body can be fixed on the structure which users want to protect. For example, the main body can be firmly disposed on the keyboard 4 of a laptop personal computer, such as shown in FIG. 3 and FIG. 4. Accompanied, the release mechanism 3 is disposed near to the main body 1. When user is going to lock the computer, the cable head 2 is inserted in the main body 1. In the insertion, the insertion end 21 of the cable head 2 presses against and separates the positioners 11, allowing the insertion end 21 to move in the main body 1. After the insertion end 21 inserts in the main body 1, the positioners 11 are pressed and returned to the first positions by the elastic mechanism 12. The positioners 11 block the insertion end 21, as shown in FIG. 3. The cable head 2 and the main body 1 are unable to be separated from each other. When user is going to release or remove the computer, the key 33 is inserted in the lock 31, driving the second pushing portion 32 to rotate. The second pushing portion 32 presses against the positioners 11 toward the release position. The hook portions 112 are then separated, as shown in FIG. 4. Blocking of the insertion end 21 caused by the positioners 11 is relieved. User can draw the cable head out of the main body, separating the cable head and the main body.

Please refer to FIG. 5 to FIG. 9 for a second embodiment of the present invention. In the second embodiment, each of two fixation members 14' projects on an outside surface of the main body 1 and near one the groove 102, each fixation member 14' has an installation portion such as a post 141, and the two installation portion oppositely laterally face each other, that is, the two posts 141 are oppositely laterally extending. It is noted that the installation portion may be provided in other type of structure such as, but not limited to, a recess. Each installation post 141 corresponds to one the part of the positioner 11, and the two positioners 11 are urged between the two installation posts 141 by the two springs 13. The release mechanism 3 is selectively swingable toward the two positioners 14' to move the two positioners 14' substantially in parallel away from each other, so that the block of the two positioners 14' and the insertion end 21 is released.

It is noted that, in an alternative embodiment, each positioner and a part of the elastic mechanism may be integrally formed as a single piece, and the two positioners can move substantially in parallel toward each other so as to releasably block the insertion end which is inserted in the main body.

Therefore, user can insert the cable head in the main body, locking the cable head and the main body quickly and automatically. The cable head is unable to be removed from the main body directly. For removing the cable head, user should only insert and rotate the key, the engagement of the cable head and the main body is then relieved. The cable head is then removable from the main body. As such, the operation of locking and releasing preformed is quick, easy, and convenient. In addition, the main body and the release mechanism are two individual components (only the contact of the second pushing portion and the positioners are necessary). The main body and the release mechanism can be settled to hide the release mechanism. For example, the release mechanism can be settled away form the user of the computer. The release mechanism can be hidden for burglarproof.

What is claimed is:

1. An engagement structure for a cable head, one end of the cable head being formed with an insertion end, the engagement structure comprising:

a main body, having two fixation members oppositely fixedly disposed thereon, two grooves oppositely arranged and laterally slit at two opposite sides thereof, two positioners oppositely slidably arranged in the two grooves and substantially in parallel, and an elastic mechanism disposed between the two fixation members and the two positioners, each positioner being not positionally pivoted to the main body, the elastic mechanism urging the two positioners to tend to move substantially in parallel toward each other so as to releasably block the insertion end which is inserted in the main body;

a release mechanism, selectively driving the two positioners to move substantially in parallel away from each other to release block of the two positioners and the insertion end so that the insertion end is withdrawable outside form the main body;

wherein the insertion end is removably insertable in the main body, and the insertion end is releasably blockable with the two positioners when the insertion end is inserted into the main body;

wherein the release mechanism is arranged separately beside the main body and the positioners, a protruding portion of the release mechanism is selectively movable toward the two positioners to press the positioners so that the two positioners move substantially in parallel away from each other and the block of the two positioners and the insertion end is released;

wherein part of each positioner is protrusive from an interior of the main body to outside an outer surface of the main body, opposite to an opening of the main body through which the insertion end is inserted, and pressable from an outside of the main body;

wherein the protruding portion of the release mechanism is disposed outside the outer surface of the main body, the protruding portion of the release mechanism is selectively movable toward the parts of the two positioners to press the parts of the positioner from the outside of the main body.

2. The engagement structure for a cable head of claim 1, wherein each positioner has a guiding portion, the insertion end has a first pushing portion, when the insertion end inserts in the main body, the first pushing portion presses on the guiding portions of the two positioners, driving the positioner to move in parallel away from each other.

3. The engagement structure for a cable head of claim 1, wherein one end of each positioner has a hook portion, the insertion end of the cable head has a limiting portion, and the hook portions block the limiting portion when the insertion end is inserted into the main body.

4. The engagement structure for a cable head of claim 1, wherein the positioners are located at two corresponding sides of the insertion end when the insertion end is inserted in the main body.

5. The engagement structure for a cable head of claim 1, wherein the release mechanism has a second pushing portion provided on the protruding portion, and the second pushing portion selectively presses the positioners so that the two positioners move substantially in parallel away from each other and the block of the two positioners and the insertion end is released.

6. The engagement structure for a cable head of claim 1, wherein each fixation member is formed as a cover and the two fixation members are removably hooked on two corresponding sides of the main body, each fixation member covers one of the two grooves and urges one of the two positioners through the elastic mechanism, the two positioners are restricted by the two fixation members so that the two positioners are unable to move apart from the main body, and the elastic mechanism is covered inside the main body by the two fixation members.

7. The engagement structure for a cable head of claim 6, wherein the elastic mechanism includes two springs which are disposed between the two fixation members and the two positioners respectively, and the two springs are covered inside the main body by the two fixation members.

8. The engagement structure for a cable head of claim 1, wherein each fixation member projects on the outer surface of the main body and near one the groove, each fixation member has an installation portion, the two installation portion oppositely laterally face each other, the installation portions correspond to the parts of the positioners respectively, and the parts of the two positioners are urged between the two installation portions by the elastic mechanism.

9. The engagement structure for a cable head of claim 8, wherein the elastic mechanism includes two springs which are disposed between the two fixation members and the two positioners respectively, the two springs are disposed outside the outer surface of the main body and manually detachable from the outside of the main body, and the parts of the two positioners are urged between the two installation portions by the two springs respectively.

10. The engagement structure for a cable head of claim 1, wherein each part of the positioner has guiding surface outside the outer surface of the main body, the guiding surfaces face toward and distanced from each other, the guiding surfaces are formed with tilted surfaces at top ends thereof respectively, the tilted surfaces corresponds to and distanced from each other, and the protruding portion of the release mechanism is movable toward the tilted surfaces to press the tilted surfaces.

11. The engagement structure for a cable head of claim 1, wherein the main body and the release mechanism are for being disposed within a structure to be protected, the insertion end of the cable head is selectively inserted into the main body and within the structure to be protected to be releasably blockable with the two positioners.

* * * * *